US007805934B1

(12) United States Patent
Nuel et al.

(10) Patent No.: US 7,805,934 B1
(45) Date of Patent: Oct. 5, 2010

(54) DISPLACER MOTION CONTROL WITHIN AIR ENGINES

(75) Inventors: Brian P. Nuel, Nederland, CO (US); Samuel P. Weaver, Boulder, CO (US)

(73) Assignee: Cool Energy, Inc., Knoxville, TN (US)

( * ) Notice: Subject to any disclaimer, the term of this patent is extended or adjusted under 35 U.S.C. 154(b) by 413 days.

(21) Appl. No.: 11/734,883

(22) Filed: Apr. 13, 2007

(51) Int. Cl.
*F01B 29/10* (2006.01)
*F02G 1/04* (2006.01)
*F25B 9/00* (2006.01)

(52) U.S. Cl. ..... 60/518; 60/517; 62/6; 62/520

(58) Field of Classification Search ..... 60/517–526
See application file for complete search history.

(56) References Cited

U.S. PATENT DOCUMENTS

| | | | | |
|---|---|---|---|---|
| 3,006,146 | A | 10/1961 | Jackson | |
| 3,533,232 | A | 10/1970 | Hodgson | |
| 3,638,420 | A | 2/1972 | Kelly et al. | |
| 3,772,883 | A | 11/1973 | Davoud et al. | |
| 3,996,745 | A | 12/1976 | Davoud et al. | |
| 4,055,962 | A | 11/1977 | Terry | |
| 4,148,195 | A | 4/1979 | Gerstmann et al. | |
| 4,149,389 | A | 4/1979 | Hayes et al. | |
| 4,195,482 | A * | 4/1980 | Moloney | 60/517 |
| 4,313,304 | A | 2/1982 | Hunt | |
| 4,433,550 | A * | 2/1984 | Durenec | 62/6 |
| 4,522,033 | A * | 6/1985 | Jensen | 62/6 |
| 4,532,778 | A | 8/1985 | Clark et al. | |
| 4,586,334 | A | 5/1986 | Nilsson, Sr. et al. | |
| 4,753,072 | A | 6/1988 | Johansson et al. | |
| 4,856,280 | A * | 8/1989 | Chagnot | 60/522 |
| 4,894,989 | A | 1/1990 | Mizuno et al. | |
| 4,897,997 | A | 2/1990 | Meijer et al. | |
| 5,010,734 | A | 4/1991 | Ho | |
| 5,115,157 | A | 5/1992 | Blumenau | |
| 5,195,321 | A | 3/1993 | Howard | |

(Continued)

FOREIGN PATENT DOCUMENTS

DE 19843600 A1 3/1999

(Continued)

OTHER PUBLICATIONS

Senfit, James R., "An Introduction to Stirling Engines," Moriya Press, 1993, pp. 40-43.

(Continued)

*Primary Examiner*—Thomas E Denion
*Assistant Examiner*—Christopher Jetton
(74) *Attorney, Agent, or Firm*—Townsend and Townsend and Crew LLP

(57) ABSTRACT

Methods and apparatus are disclosed for generating power. A thermodynamic air engine is configured to convert heat provided in the form of a temperature differential to mechanical energy. The thermodynamic air engine has a working fluid and a displacer adapted to move through the working fluid. The temperature differential is established across the thermodynamic air engine between a first side of the engine and a second side of the engine. The displacer is directly actuated to move the displacer cyclically through the working fluid in accordance with a defined motion pattern.

23 Claims, 7 Drawing Sheets

U.S. PATENT DOCUMENTS

| | | | | |
|---|---|---|---|---|
| 5,228,293 | A | 7/1993 | Vitale | |
| 5,428,653 | A | 6/1995 | El-Genk | |
| 5,442,913 | A * | 8/1995 | Cho et al. | 60/518 |
| 5,638,684 | A | 6/1997 | Siegel et al. | |
| 5,706,659 | A | 1/1998 | Houtman | |
| 5,782,084 | A * | 7/1998 | Jarvis | 60/518 |
| 5,875,863 | A * | 3/1999 | Jarvis et al. | 180/65.245 |
| 5,899,071 | A | 5/1999 | Stone et al. | |
| 5,916,140 | A | 6/1999 | Hageman | |
| 5,918,463 | A | 7/1999 | Penswick et al. | |
| 5,934,076 | A | 8/1999 | Coney | |
| 6,286,310 | B1 * | 9/2001 | Conrad | 60/520 |
| 6,305,442 | B1 | 10/2001 | Ovshinsky et al. | |
| 6,330,800 | B1 | 12/2001 | Price et al. | |
| 6,470,679 | B1 | 10/2002 | Ertle | |
| 6,536,207 | B1 | 3/2003 | Kamen et al. | |
| 6,606,860 | B2 | 8/2003 | McFarland | |
| 6,625,992 | B2 | 9/2003 | Maguire et al. | |
| 6,701,721 | B1 | 3/2004 | Berchowitz | |
| 6,843,057 | B2 * | 1/2005 | Yamamoto | 60/520 |
| 6,948,315 | B2 | 9/2005 | Kirby et al. | |
| 2003/0074897 | A1 * | 4/2003 | Rollston | 60/517 |
| 2005/0172623 | A1 | 8/2005 | Hurt | |
| 2005/0279094 | A1 | 12/2005 | Yoshino | |

FOREIGN PATENT DOCUMENTS

| | | | |
|---|---|---|---|
| JP | 4093559 | A | 3/1992 |

OTHER PUBLICATIONS

"Low-Cost Solar-Thermal-Electric Power Generation," author unknown, found online on Jul. 18, 2008 at http://www.cs.berkeley.edu/~artin/Research/research.html, 6 pages.

Der Menassians, Artur, "Stirling Engines for Low-Temperature Solar-Thermal-Electric Power Generation," Written Dissertation from the University of CA Berkeley, 2007, 205 pages.

Der Menassians, Artur, "Stirling Engines for Low-Temperature Solar-Thermal-Electric Power Generation," Dissertation Talk, Nov. 19, 2007, 34 pages.

* cited by examiner

DISPLACER MOTION CONTROL WITHIN AIR ENGINES

BACKGROUND OF THE INVENTION

This application relates generally to thermodynamic air engines. More specifically, this application relates to controlled motion of a displacer within a thermodynamic air engine.

The use of thermodynamic techniques for converting heat energy into mechanical, electrical, or some other type of energy has a long history. The basic principle by which such techniques function is to provide a large temperature differential across a thermodynamic engine and to convert the heat represented by that temperature differential into a different form of energy. Typically, the heat differential is provided by hydrocarbon combustion, although the use of other techniques is known. Using such systems, power is typically generated with an efficiency of about 30%, although some internal-combustion engines have efficiencies as high as 50% by running at very high temperatures.

Thermodynamic air engines are one class of thermodynamic engine in which a displacer acts to circulate a displacer fluid within a working chamber comprised by the air engine. A specific type of air engine that meets this criterion is a "Stirling engine," but other types of air engines also share this characteristic.

Throughout industrial history, Stirling engines and other types of air engines have been used for applications, such as pumping water and powering machinery. Recent uses of the Stirling engine have been in electrical power generation. Stirling-engine-powered generators have been installed on submarines as well as on satellites. Portable, external-combustion power-generation units have been produced in quantity. Large-scale solar-heated Stirling cycle power generation units have been shown to produce power reliably on a commercial scale.

While various power-generation techniques exist in the art, there is still a general need for the development of alternative techniques for generating power. For example, while the history of thermodynamic air engines is long, there remain a variety of inefficiencies associated with their operation. There is accordingly still a need in the art for improved methods of operating thermodynamic air engines.

BRIEF SUMMARY OF THE INVENTION

Embodiments of the invention accordingly provide methods and apparatus for generating power. A thermodynamic air engine is configured to convert heat provided in the form of a temperature differential to mechanical energy. The thermodynamic air engine comprises a working fluid and a displacer adapted to move through the working fluid. The temperature differential is established across the thermodynamic air engine between a first side of the engine and a second side of the engine. The displacer is directly actuated to move the displacer cyclically through the working fluid in accordance with a defined motion pattern.

The motion pattern may comprise a first half cycle effected over a first time. The first half cycle comprises motion of the displacer from a first position proximate the first side to a second position proximate the second side effected over a first motion time small in comparison to the first time. It also comprises maintenance of the displacer substantially at the second position for a remainder of the first time. The motion pattern may also comprise a second half cycle effected over a second time. The second half cycle comprises motion of the displacer from the second position to the first position over a second motion time small in comparison to the second time. It also comprises maintenance of the displacer substantially at the first position for a remainder of the second time. In some embodiments, the first time is substantially equal to the second time.

The mechanical energy generated with the thermodynamic air engine may be converted to electrical energy in some embodiments. In addition, the motion pattern may be designed to optimize an operational efficiency of the thermodynamic air engine. In certain embodiments, the displacer comprises a thermally insulating material.

There are a variety of ways in which the direct actuation may be achieved in specific embodiments. For instance, in one embodiment, the thermodynamic air engine further comprises an electronic solenoid interfaced with the displacer so that the displacer may be directly actuated by operating the electronic solenoid to move the displacer. In another embodiment, the thermodynamic engine further comprises a linear stepper motor interfaced with the displacer so that the displacer may be directly actuated by operating the linear stepper motor to move the displacer. In a further embodiment, the thermodynamic engine further comprises a rotary motor interfaced with the displacer so that the displacer may be directly actuated by operating the rotary motor to move the displacer. Examples of rotary motors that may be used include a rotary dc motor, a rotary ac motor, and a rotary stepper motor, among others. In some instances, the displacer may be directly actuated by compressing a fluid and directing the compressed fluid to move the displacer. A suitable fluid is air.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sublabel is associated with a reference numeral and follows a hyphen to denote one of multiple similar components. When reference is made to a reference numeral without specification to an existing sublabel, it is intended to refer to all such multiple similar components.

DETAILED DESCRIPTION OF THE INVENTION

Figures 1A, 1B, 1C, 1D:
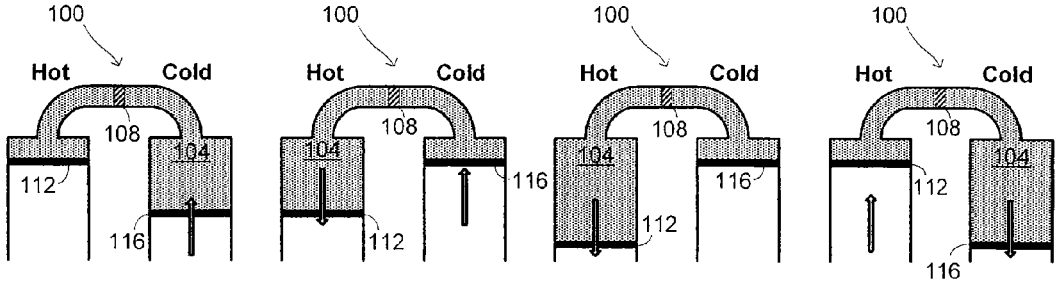
FIGS. 1A-1D show different stages in the operation of a two-piston alpha-type Stirling engine.

Embodiments of the invention provide for real-time external programmable control of the motion of a displacer within a thermodynamic air engine. A Stirling engine is sometimes referred to in the art as an "external combustion engine" and typically operates by burning a fuel source to generate heat that increases the temperature of a working fluid, which in turn performs work. The operation of one type of conventional Stirling engine is illustrated in FIGS. 1A-1E. Each of FIGS. 1A-1D shows the configuration of the Stirling engine 100 at a different position during a single cycle, with the engine 100 operating by changing positions sequentially from FIG. 1A to FIG. 1D and then returning to the configuration shown in FIG. 1A. The phase diagram shown in FIG. 1E also shows this cycle, but from the perspective of relevant thermodynamic variables. The phase diagram is a pressure-volume diagram, with pressure being plotted on the ordinate and volume being plotted on the abscissa. Relevant isotherms 124 and 128 are shown with dotted lines.

The mechanical energy produced by the Stirling engine 100 is indicated by positions of pistons 112 and 116. To use or retain the energy, the pistons 112 and 116 may be connected to a common shaft that rotates or otherwise moves in accordance with the changes in piston positions that result from operation of the engine 100. A confined space between the two pistons 112 and 116 is filled with a compressible fluid 104, usually a compressible gas. The temperature difference is effected by keeping one portion of the fluid 104, in this instance the portion on the left, in thermal contact with a heat source and by keeping the other portion, in this instance the portion on the right, in thermal contact with a heat sink. With such a configuration, piston 112 is sometimes referred to in the art as an "expansion piston" and piston 116 is sometimes referred to as a "compression piston." The portions of the fluid are separated by a regenerator 108, which permits appreciable heat transfer to take place to and from the fluid 104 during different portions of the cycle described below. This heat transfer either preheats or precools the fluid 104 as it transitions from one chamber to the other.

Figure 1E:
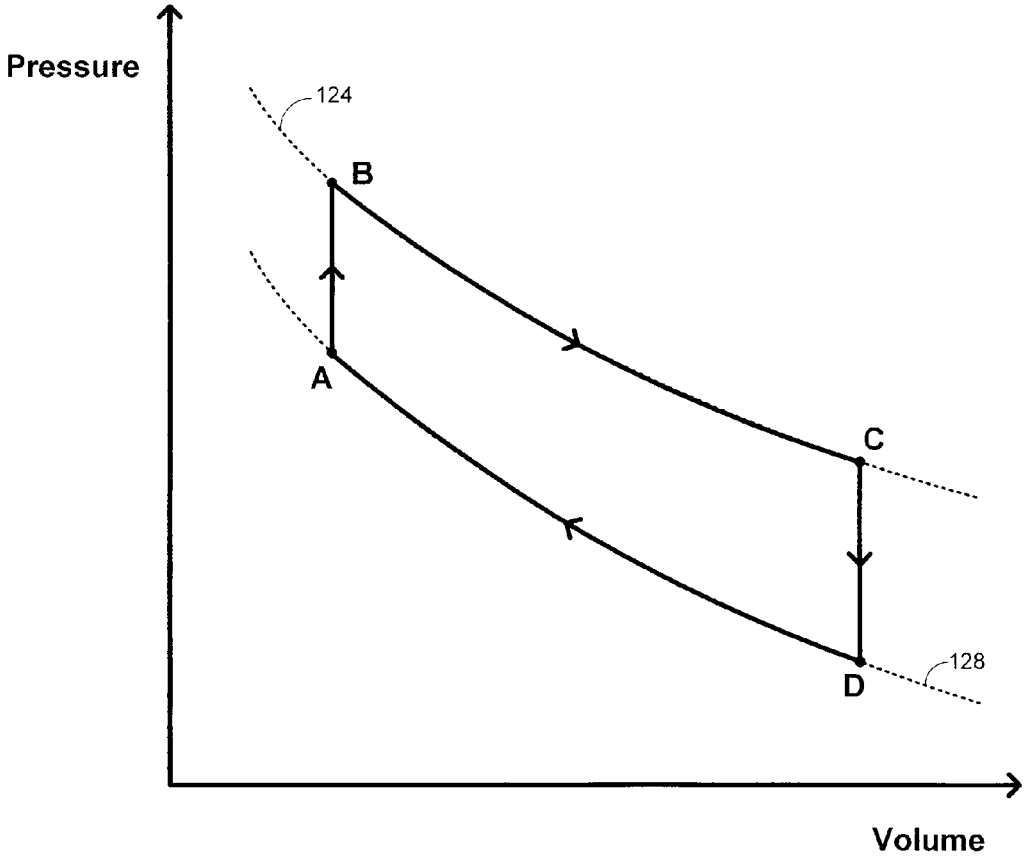
FIG. 1E is a phase diagram showing the thermodynamic operation of the Stirling engine.

When the engine is in the position shown in FIG. 1A, the fluid 104 has a pressure and volume that correspond to point "A" in FIG. 1E. In this phase diagram, isotherm 128 corresponds to a temperature $T_c$ of the cold side and isotherm 124 corresponds to a temperature $T_h$ of the hot side. During the portion of the cycle from FIG. 1A to FIG. 1B, the expansion piston 112 moves down at the same time that the compression piston 116 moves up, maintaining a constant volume for the fluid 104. During such a change, fluid 104 passes through the regenerator 108 from the cold side to the hot side. Heat $Q_R$ supplied by the regenerator 108 causes the fluid to enter the hot side at temperature $T_h$. The constant volume of this part of the cycle is represented by a vertical line in FIG. 1E to point "B."

The transition to the configuration shown in FIG. 1C is achieved by maintaining the compression piston 116 in a substantially fixed position while moving the expansion piston 112 downwards to increase the volume containing the fluid 104. This causes the fluid to undergo a substantially isothermal expansion, as represented in the phase diagram by a traversal along isotherm 124 to point "C." During this expansion, heat $Q_h$ is absorbed into the working fluid at temperature $T_h$ from the thermal contact of the fluid 104 with the heat source. The heat is turned into mechanical work W during this expansion.

The portion of the cycle to FIG. 1D is a counterpart to the portion of the cycle between the configurations of FIGS. 1A and 1B, with both pistons 112 and 116 moving in concert to maintain a substantially constant volume. In this instance, however, fluid is forced in the other direction through the regenerator 108, causing a decrease in temperature to $T_c$ represented by the vertical line in FIG. 1E to point "D." During this part of the cycle, substantially the same amount of heat $Q_R$ absorbed during the transition between FIGS. 1A and 1B is given up to the regenerator 108. The two constant-volume transitions in the cycle accordingly have substantially no net effect on the heat-transfer characteristics of the process.

Finally, a return is made to the configuration of FIG. 1A by moving the compression piston 116 upwards while maintaining the expansion piston 112 in a substantially fixed position. The resulting compression of the fluid 104 is again substantially isothermic, as represented by the traversal along isotherm 128 at temperature $T_c$ in FIG. 1E back to point "A." During this compression, heat $Q_c$ is removed from the working fluid as a result of contact of the fluid 104 with the heat sink.

The net result of the cycle is a correspondence between (1) the mechanical movement of the pistons 112 and 116 and (2) the absorption of heat $Q_h$ at temperature $T_h$ and the rejection of heat $Q_c$ at temperature $T_c$. The work performed by the pistons 112 and 116 is accordingly $W=|Q_h-Q_c|$.

The type of Stirling engine illustrated in FIGS. 1A-1D is a two-piston type of Stirling engine. This type of configuration is sometimes referred to in the art as having an "alpha" configuration. Other configurations for Stirling engines may be implemented that traverse a similar thermodynamic path through the pressure-volume phase diagram of FIG. 1E.

One alternative configuration that is sometimes referred to as having a "beta" type of configuration provides two pistons within a common cylinder and connected with a common crankshaft. Such a configuration is illustrated schematically in FIGS. 2A-2D. The beta Stirling engine 200 comprises a cylinder 216 within which a power piston 208 and a displacer piston 212 may move. Both pistons 208 and 212 are linked with a common flywheel 204. In the configuration in FIG. 2A, the power piston 208 has compressed the working fluid and the displacer piston 212 has moved so that most of the fluid is proximate the hot side where it can be exchanged with a hot heat exchanger.

Figures 2A, 2B, 2C, 2D:
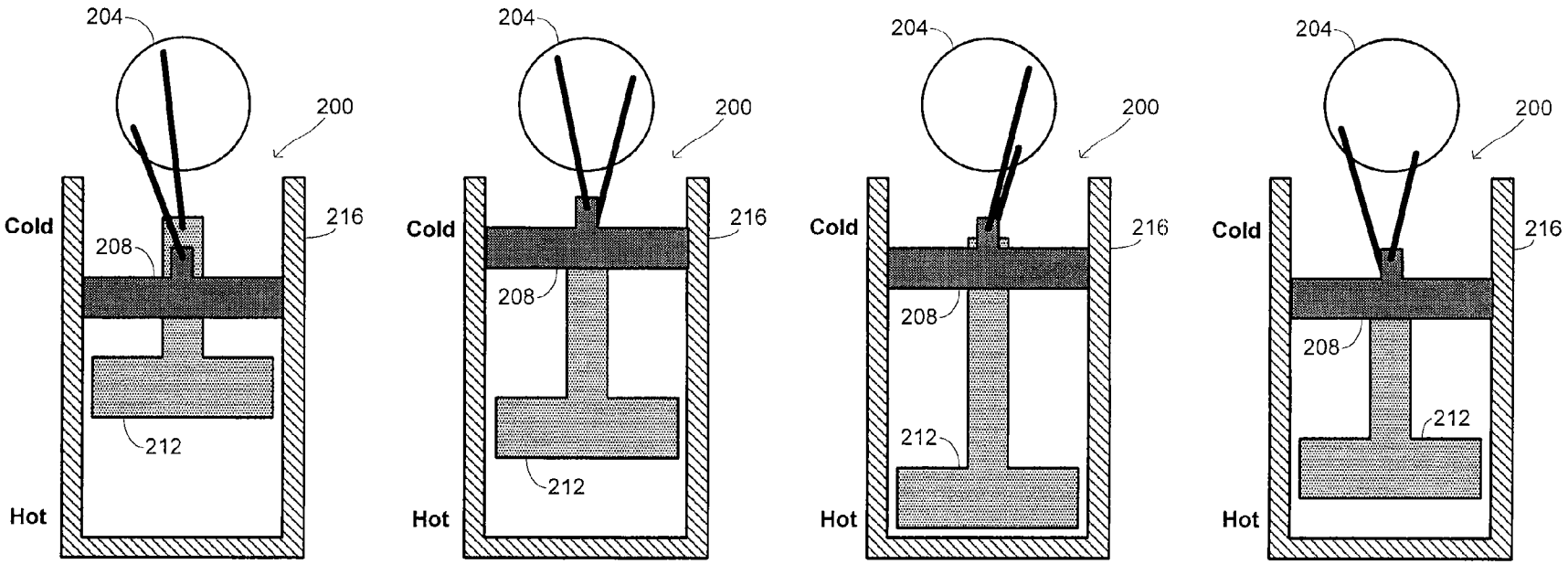
FIGS. 2A-2D show different stages in the operation of a two-displacer-type Stirling engine sometimes described as a beta-type engine.

During the power stroke illustrated in FIG. 2B, the heated working fluid pushes the power pistor 208 along the cylinder 216. The displacer piston 212 then moves as illustrated in FIG. 2C to shunt the fluid to the cold side. The cooled fluid is subsequently compressed by the momentum of the flywheel 204.

Another alternative configuration for a Stirling engine uses a displacer-type of engine, an example of which is illustrated schematically in FIGS. 3A-3D. This type of configuration is sometimes referred to in the art as having a "gamma" configuration. The fundamental principle of operation of the displacer type of Stirling engine is the same as for the two-piston type of Stirling engine in that thermal energy represented by a temperature differential is converted to mechanical energy. Fundamentally, the gamma engine is similar to the beta engine except that the power piston and displacer piston are not coaxial.

With the displacer-type of Stirling engine 300, fluid 324 that expands with a heat-energy increase is held within an enclosure that also includes a displacer 328. To simplify the illustration, a regenerator is not shown explicitly in the drawings, but may be included to improve the efficiency of the engine. The fluid 324 is typically a gas. One or both sides of the engine 300 are maintained in thermal contact with respective thermal reservoirs to maintain the temperature differential across the engine. In the illustration, the top of the engine 300 corresponds to the cold side and the bottom of the engine 300 corresponds to the hot side. A displacer piston 304 is provided in mechanical communication with the displacer 328 and a power piston 308 is provided in mechanical communication with the fluid 324. Mechanical energy represented by the motion of the power piston 308 may be extracted with any of a variety of mechanical arrangements, with the drawing explicitly showing a crankshaft 316 in mechanical communication with both the displacer and power pistons 304 and 308. The crankshaft is illustrated as mechanically coupled with a flywheel 320, a common configuration. This particular mechanical configuration is indicated merely for illustrative purposes since numerous other mechanical arrangements will be evident to those of skill in the art that may be coupled with the power piston 308 in extracting mechanical energy. In these types of embodiments, the displacer 328 may also have a regenerator function to permit heat transfer to take place to and from the fluid 324 during different portions of the cycle. Another arrangement common in these types of embodiments comprises a displacer that forms a seal with the walls of the expansion chamber, and whose motion forces the fluid through guides that lead into the other half of the chamber past a regenerator.

Figure 3A:
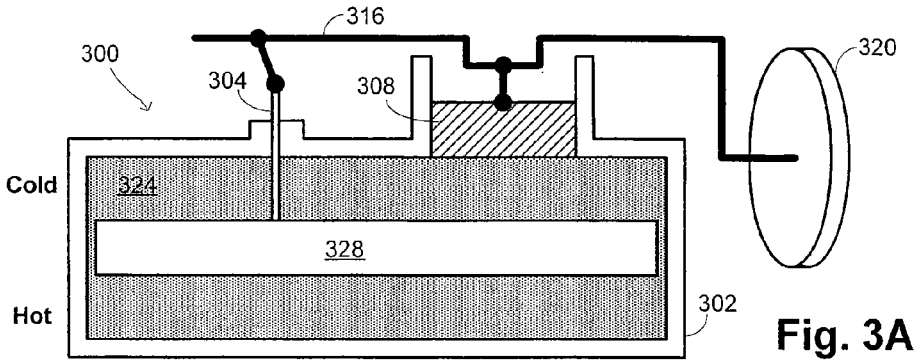
FIGS. 3A-3D show different stages in the operation of a displacer-type Stirling engine sometimes described as a gamma-type engine illustrated without a regenerator.
Figure 3B:
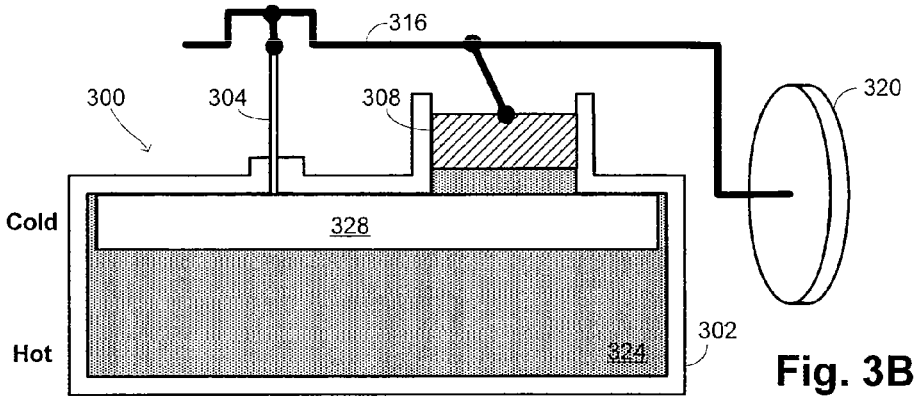

When the displacer Stirling engine 300 is in the configuration shown in FIG. 3A, it has a thermodynamic state corresponding to point "A" in FIG. 1E. Heating of the fluid 324 on the lower side of the engine 300 causes the pressure to increase, resulting in movement of the power piston 308 upwards as illustrated in FIG. 3B. This transition is represented thermodynamically in FIG. 1E with a transition to point "B." With the fluid 324 primarily in contact with the hot side of the engine, expansion of the fluid 324 takes place to drive the power piston 308 further upwards. This transition is substantially isothermic and is illustrated in FIG. 1E with a transition to point "C," corresponding to the arrangement shown in FIG. 3C.

Figure 3C:
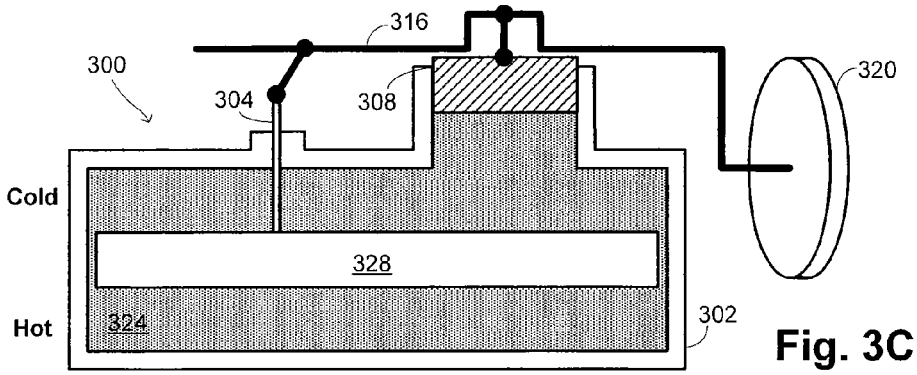
Figure 3D:
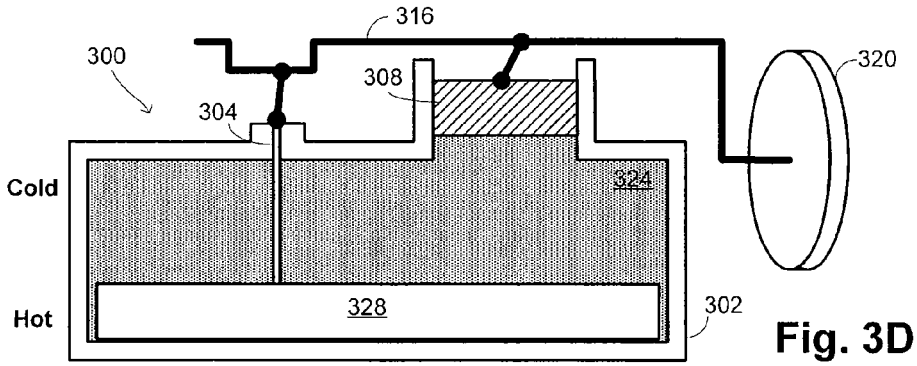

In FIG. 3C, expansion of the fluid 324 has been accompanied by reverse motion of the displacer 328, causes more of the fluid 324 to come in contact with the cold side of the engine 300 and thereby reduce the pressure. This is illustrated in FIG. 1E with the transition to point "D," corresponding to the arrangement shown in FIG. 3D. Cooling of the fluid 324 induces a substantially isothermic contraction illustrated in FIG. 1E with a return to point "A" and with the engine returning to the physical configuration shown in FIG. 3A.

This basic cycle is repeated in converting thermal energy to mechanical energy. In each cycle, the pressure increases when the displacer 328 is in the top portion of the enclosure 302 and decreases when the displacer 328 is in the bottom portion of the enclosure 302. Mechanical energy is extracted from the motion of the power piston 308, which is out of phase with the displacer piston 304, the preferred phase difference depending in many respects on specific engine parameters.

Embodiments of the invention are described below with specific reference to displacer-type Stirling engines. This is intended to be exemplary rather than limiting since the invention may be more generally adapted to any type of air engine. For example, while the embodiments below describe affecting the motion of a single displacer, the same principles may be applied in which multiple mechanical components are to be moved. For instance, the invention may be applied to the two-piston alpha-type Stirling engine described in connection with FIGS. 1A-1E, although there are certain evident simplifications that may be achieved when only a single displacer is to be moved.

There are a number of different methods that are known in the art for displacer actuation, and embodiments of the invention may be applied to the the different methods. For example, a first category of methods for displacer actuation uses a mechanical linkage to drive the displacer. Such methods typically use a spinning crankshaft coupled with the mechanical linkage. Examples of suitable mechanical linkage include a connecting rod link; a connecting rod link with a bellcrank; a yoke, examples of which include Scotch or Ross yokes; rhombic drives; and the like.

Figure 4A:
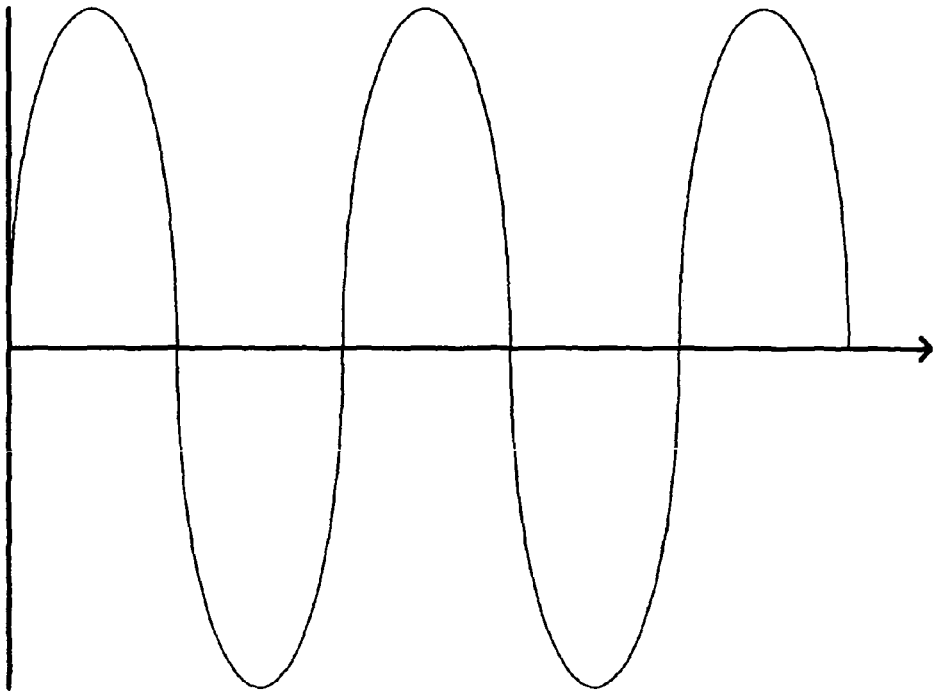
FIGS. 4A and 4B compare sinusoidal and trapezoidal displacer motions as implemented in different prior-art air engines.
Figure 4B:
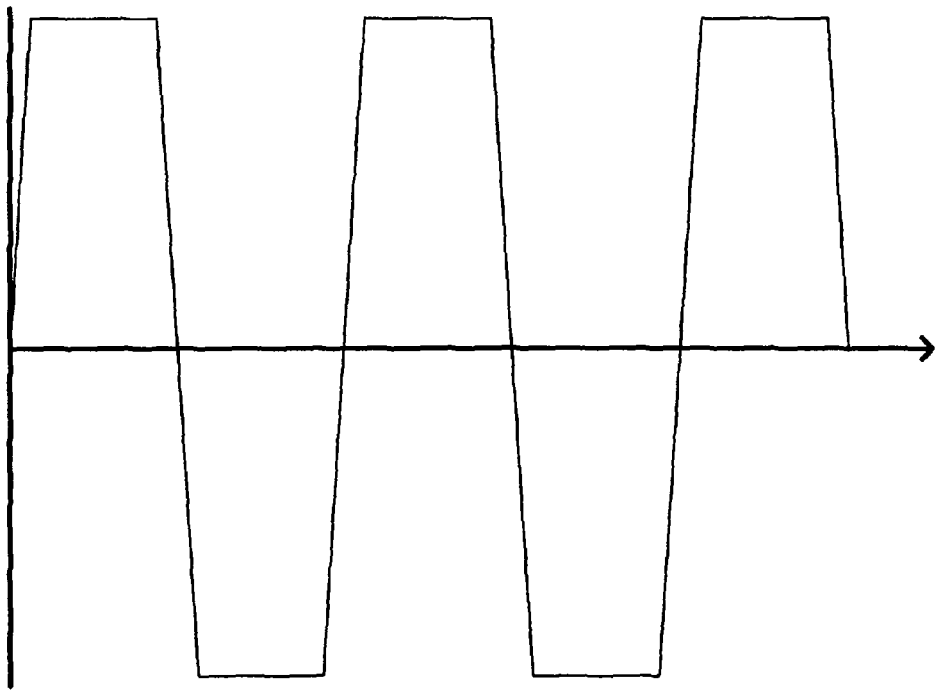

This category of methods is characterized by a number of disadvantages. First, there are usually a relatively large number of sliding and rolling interfaces within the mechanical linkage. Each sliding or rolling interface adds to the overall frictional loss. Second, most mechanical linkages result in a sinusoidal motion of the displacer. This general shape is shown in FIG. 4A and acts to reduce the potential power output of the engine—the motion is not ideal from the standpoint of the thermodynamic cycle taking place within the engine. The result is a realized thermodynamic cycle that is a relatively poor approximation of the ideal Carnot cycle. It results in a lower power output per cycle compared with the output potentially available from the system. Various mechanical linkages have sometimes been proposed to modify the displacer motion from the conventional sinusoidal motion to a trapezoidal motion that is a somewhat better approximation of the ideal Carnot cycle. This shape of this motion is shown in FIG. 4B and allows the displacer to pause for a brief moment at both extremes of its motion to allow the power piston strokes to take place in a more nearly isothermal manner. One such type of linkage is referred to as a "displacer slip-link" or "lost-motion" linkage and results in intermittent motion of the displacer. Cams can also be used to produce trapezoidal motion of the displacer.

The second category of methods for displacer actuation may be described as using a "free-piston" design family, which is sometimes described in the art as using "Ringbom" control. Such methods use a low-friction piston that is actuated by the pressure of the working gas within the thermodynamic air engine. These methods are generally characterized by less friction than mechanical linkages because the only interface relative to the displacer is provided by a single low-friction sliding piston. In addition, the Ringbom methods produce more favorable displacer motion that more closely resembles the trapezoidal motion shown in FIG. 4B without the need for complex mechanical linkages, particularly at slow engine speeds. But this method of displacer motion does create a power loss within the engine. A portion of the power within the expansion stroke is used to move the displacer via the motion of the free piston that is attached to it. This power would otherwise be transmitted through the power piston to the output linkage.

Both the mechanical linkage and Ringbom methods lack real-time control of the displacer motion. In both of these methods, the displacer moves in unison with the motion of the crankshaft according to the natural speed of the engine. As the engine is running, there is no way to alter the motion of the displacer to better control the engine speed or performance.

Figure 5A:
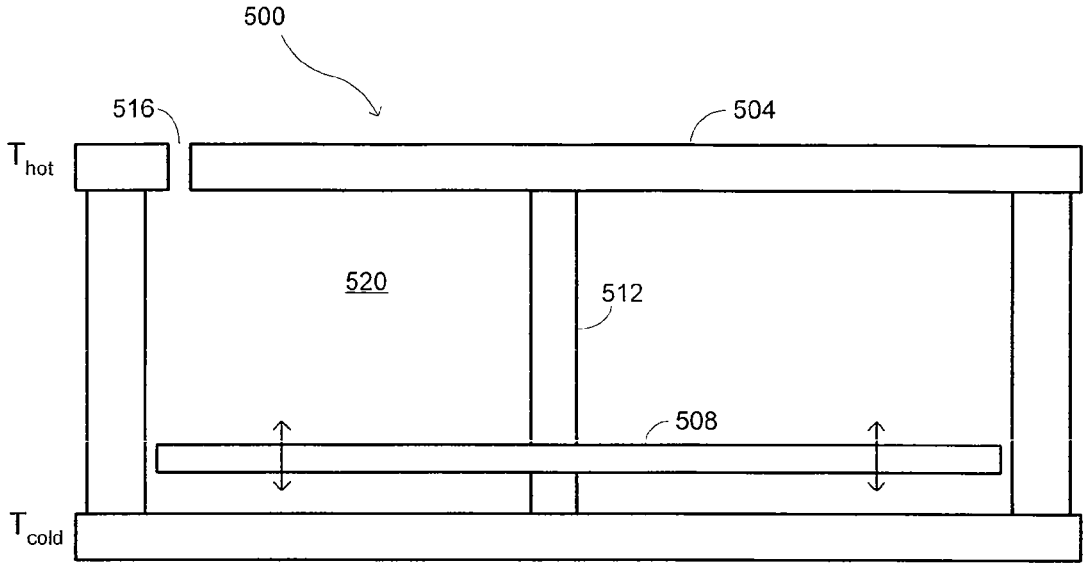
FIGS. 5A and 5B and 5C provide schematic illustrations of structures for thermodynamic air engines implemented according to embodiments of the invention.

This disadvantage is overcome in embodiments of the invention, which provide methods of real-time displacer control in thermodynamic air engines. A first embodiment is illustrated schematically in FIG. 5A, in which the relevant portion of the air engine is denoted generically by reference number 500. The air engine 500 comprises a chamber 504 that contains a working fluid 520 through which the displacer 508 moves. The temperature difference across the air engine 500 is denoted with temperatures $T_{hot}$ and $T_{cold}$, with the labels being used only to identify the existence of a temperature difference and not intended to imply any absolute value for the actual temperatures used by the engine. A port for a power piston is denoted by reference number 516.

An electrically controlled solenoid 512 is provided to move the displacer 508 to alternate sides of the engine 500 in accordance with a desired motion profile. For example, in one particular implementation, the solenoid 512 is used to move the displacer 508 quickly, with the transition occurring over a time period that is small relative to the time of one half of one cycle of the engine. For the remainder of the time of the time, the displacer 508 is held substantially stationary at one end of the engine 500. This allows the thermodynamic processes within the engine to follow the ideal Carnot cycle more closely. In specific embodiments, the displacer comprises a thermally insulating material. This may further enhance the performance of the engine as the displacer is held substantially stationary against the thermal places defining part of the chamber 504. This may further increase the overall power output of the engine. In various alternative embodiments, a linear stepper motor, a pneumatic piston, or a hydraulic piston may be substituted for the solenoid.

The ability provided by such embodiments to control the displacer motion externally and arbitrarily while the engine is running may be manifested by an ability to modify the motion of the displacer during operation of the engine to achieve the best performance of the engine given specific conditions of the driven load. For example, as the load on the engine changes, the temporal motion trajectory of the displacer, and thus of the power piston, could be altered to achieve improved, even optimal, performance. In addition, the ability to control the speed of the displacer electronically allows the ability to control the speed of the engine itself by acting as a pacing mechanism for the thermodynamic cycle.

Figure 5B:
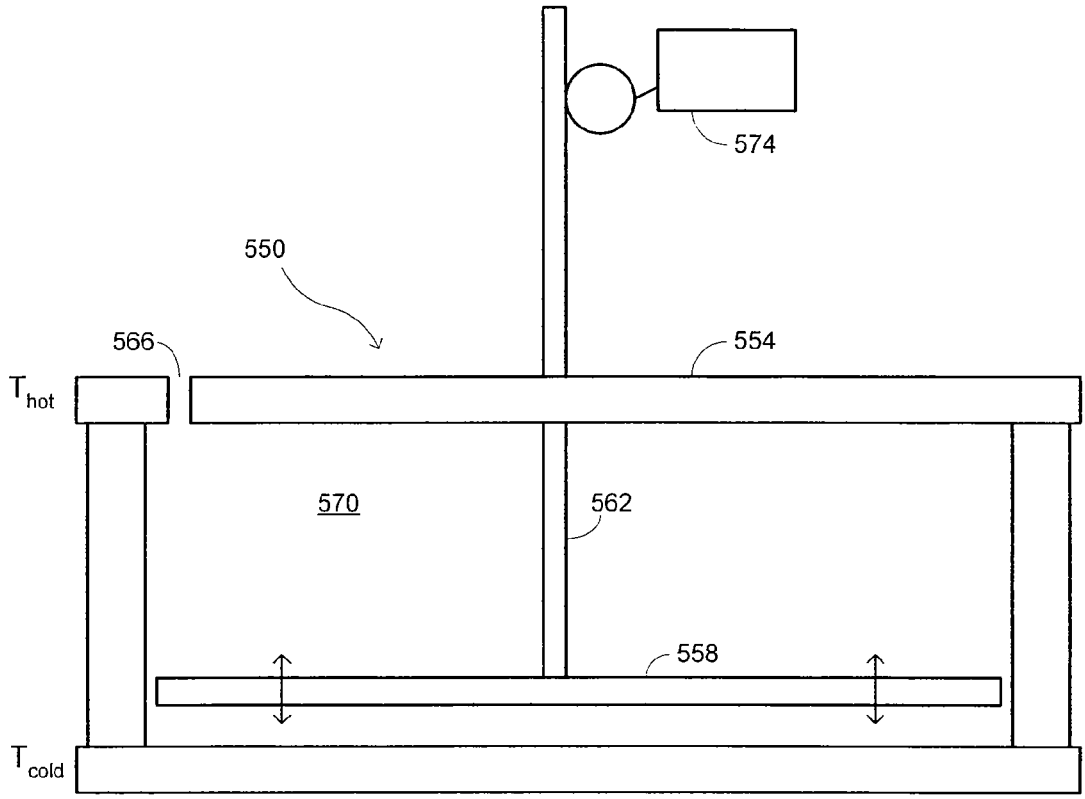
Figure 5C:
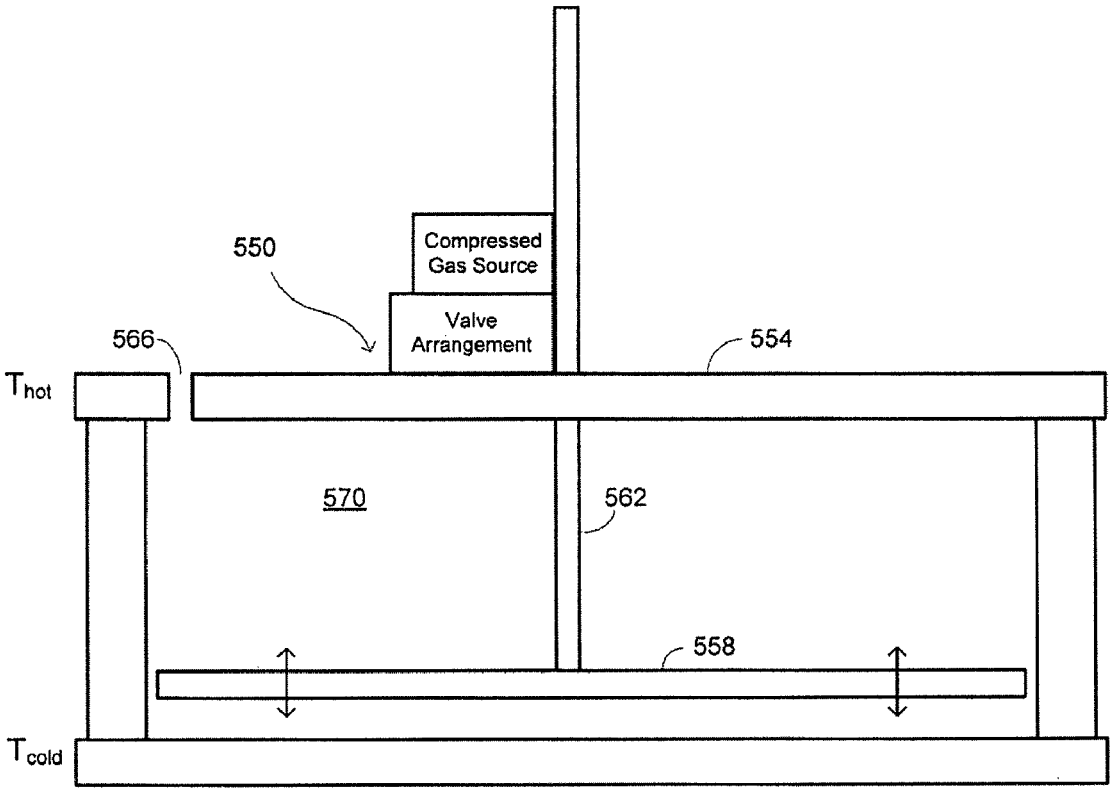

Other embodiments of the invention are illustrated schematically in FIGS. 5B and 5C, with the relevant portion of the air engine being denoted generically by reference number 550. In these illustrations, the chamber 554 holds the working fluid 570 through which the displacer 558 moves and includes a port 566 for the power piston. The temperature difference across the engine 550 is again denoted by identifying temperatures $T_{hot}$ and $T_{cold}$, but such identifications are not intended to indicate any particular absolute temperatures, instead identifying only the presence of the temperature differential across the engine 550. In an embodiment shown in FIG. 5*b*, a rotary motor 574 is used to drive the displacer 558 through a linkage 562. The rotary motor 574 may comprise an ac motor or a dc motor in different embodiments, as well as rotary stepper motors. Rotational motion is converted to linear motion imparted to the displacer 558 through rack-and-pinion gearing or other mechanisms known to those of skill in the art. In this way, a mechanism is provided for directly controlled motion of the displacer 558. In a fashion similar to the use of the embodiments that use a solenoid as described in connection with FIG. 5A, use of a rotary stepper motor may thus be used to obtain the desired motion of the displacer 558.

In certain instances, electromagnetic mechanisms may be used to drive the displacer. For instance, magnets or electrically charged components may be provided in addition to electromagnetic components comprised by the motors. Furthermore, control mechanisms beyond electronic control may be used in some embodiments, examples of which include the use of hydraulic fluids or compressed air. These mechanisms can effect control over the location of the displacer in a similar manner. A small portion of the power output of the engine could be diverted to compress the fluid, whether it be a liquid or a gas. Electronically controlled valves may then be actuated to achieve the desired motion as shown in FIG. 5*c*. Both speed and timing of the motion of the displacer may then be directly controlled in a manner similar to that described for the other embodiments.

Figure 6:
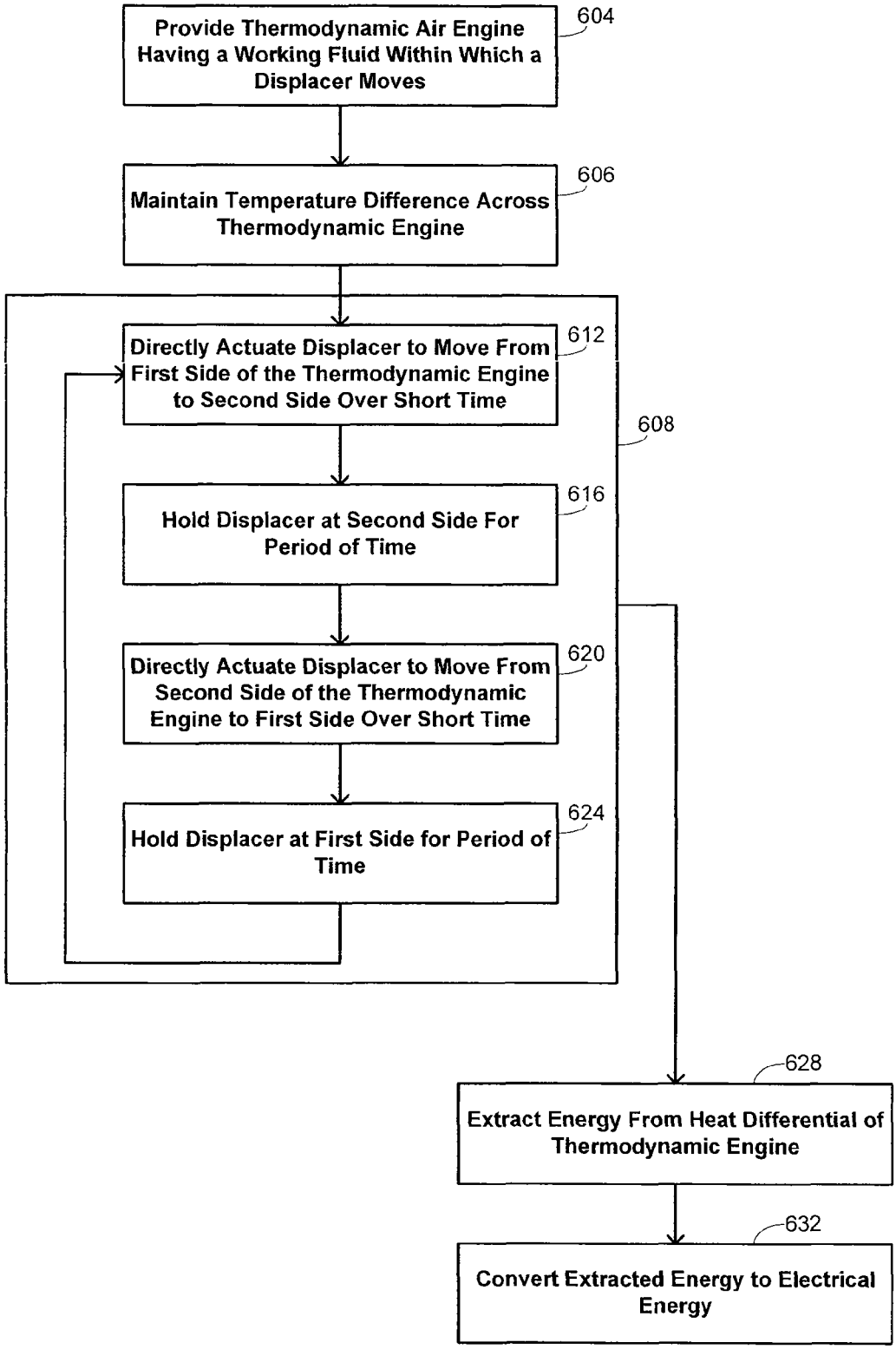
FIG. 6 is a flow diagram summarizing methods of generating power in accordance with embodiments of the invention.

FIG. 6 summarizes the general methodology by which these different mechanisms may be used for power generation in the form of a flow diagram. The methods begin at block 604 with a thermodynamic air engine being provided. It is configured as a structure that has a working fluid through which a displacer moves. Energy is generated by maintaining a temperature difference across the engine as indicated at block 606 and cyclically moving the displacer to different sides of the engine as indicated generically at block 608. Details of how the cyclic motion is implemented according to embodiments of the invention are indicated in the drawing.

At block 612, the displacer is actuated directly to move from a first side of the thermodynamic engine to a second side of the engine over a short time. The displacer is then held in a substantially fixed position at the second side for a period of time at block 616. The total time over which steps 612 and 616 occur is a half-cycle time for operation of the engine. The time over which the displacer is moved from the first side to the second side is considered to be "short" when that time is small in comparison to the half-cycle time. For example, this time might be less than 20%, less than 10%, less than 5%, less than 2%, less than 1%, less than 0.5%, less than 0.2%, or less than 0.1% of the half-cycle time in different embodiments.

The cycle is completed by directly actuating the displacer to move from the second side of the engine back to the first side at block 620 and then holding the displacer at the first side for a period of time at block 624. Again, the displacer is moved at block 620 over a short time, meaning that the time is small in comparison to the total time over which steps 620 and 624 occur. Generally, the total time over which steps 620 and 624 occur will be substantially the same as the half-cycle time over which steps 612 and 616 occur, but embodiments of the invention are sufficiently flexible that the times for these different portions of the total cycle may sometimes be different. In specific embodiments, the time over which the displacer is moved from the second side to the first side at block 620 might be less than 20%, less than 10%, less than 5%, less than 2%, less than 1%, less than 0.5%, less than 0.2%, or less than 0.1% of the half-cycle time in different embodiments.

As the cycle within block 608 is repeated, energy may be extracted from conversion of the heat differential at block 628. When appropriate, this extracted energy may be converted to electrical energy as indicated at block 632.

The engine-control methods described herein generally make use of some driving power that effectively reduces the net engine output. It is expected, however, that the increased output that results from more closely approximating the ideal Carnot cycle may more than make up for the power required to actuate the displacer directly. In addition, the ability to arbitrarily control displacer motion is expected to result in higher engine efficiency and specific power (power divided by weight) through real-time control of engine speed and output power.

Thus, having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method of generating power, the method comprising:

providing a thermodynamic air engine configured to convert heat provided in the form of a temperature differential to mechanical energy, the thermodynamic air engine comprising a working fluid and a displacer adapted to move through the working fluid;

establishing the temperature differential across the thermodynamic air engine between a first side of the thermodynamic air engine and a second side of the thermodynamic air engine; and directly actuating the displacer to move the displacer cyclically through the working fluid in accordance with a defined motion pattern, wherein the motion pattern comprises a first half cycle effected over a first time;

the first half cycle comprises:

motion of the displacer from a first position proximate the first side to a second position proximate the second side effected over a first motion time small in comparison to the first time; and maintenance of the displacer substantially at the second position for a remainder of the first time.

2. The method recited in claim 1 wherein;

the motion pattern further comprises a second half cycle effected over a second time;

the second half cycle comprises:

motion of the displacer from the second position to the first position over a second motion time small in comparison to the second time; and maintenance of the displacer substantially at the first position for a remainder of the second time.

3. The method recited in claim 2 wherein the first time is substantially equal to the second time.

4. The method recited in claim 1 further comprising converting mechanical energy generated with the thermodynamic air engine to electrical energy.

5. The method recited in claim 1 wherein the motion pattern optimizes an operational efficiency of the thermodynamic air engine.

6. The method recited in claim 1 wherein:

the thermodynamic air engine further comprises a coil and a permanent magnet mechanically coupled with the displacer; and directly actuating the displacer comprises charging the coil to generate an electromagnetic field to move the permanent magnet.

7. The method recited in claim 1 wherein:

the thermodynamic air engine further comprises an electronic solenoid interfaced with the displacer; and directly actuating the displacer comprises operating the electronic solenoid to move the displacer.

8. The method recited in claim 1 wherein:

the thermodynamic air engine further comprises a linear stepper motor interfaced with the displacer; and directly actuating the displacer comprises operating the linear stepper motor to move the displacer.

9. The method recited in claim 1 wherein:

the thermodynamic air engine further comprises a rotary motor interfaced with the displacer; and directly actuating the displacer comprises operating the rotary motor to move the displacer.

10. The method recited in claim 9 wherein the rotary motor is selected from the, group consisting of a rotary dc motor, a rotary ac motor, and a rotary stepper motor.

11. The method recited in claim 1 wherein directly actuating the displacer comprises:

compressing a fluid;

directing the compressed fluid to move the displacer.

12. The method recited in claim 11 wherein the fluid comprises air.

13. The method recited in claim 1 wherein the displacer comprises a thermally insulating material.

14. An apparatus for generating power, the apparatus comprising:

a thermodynamic air engine configured to convert heat provided in the form of a temperature differential to mechanical energy, the thermodynamic air engine comprising a working fluid and a displacer adapted to move through the working fluid; and a displacer actuator adapted to provide direct actuation of the displacer to move the displacer cyclically through the working fluid in accordance with a defined motion pattern, wherein the motion pattern comprises a first half cycle effected over a first time;

the first half cycle comprises:

motion of the displacer from a first position proximate the first side to a second position proximate the second side effected over a first motion time small in comparison to the first time; and maintenance of the displacer substantially at the second position for a remainder of the first time.

15. The apparatus recited in claim 14 wherein:

the motion pattern further comprises a second half cycle effected over a second time;

the second half cycle comprises:

motion of the displacer from the second position to the first position over a second motion time small in comparison to the second time; and maintenance of the displacer substantially at the first position for remainder of the second time.

16. The apparatus recited in claim 15 wherein the first time is substantially equal to the second time.

17. The apparatus recited in claim 14 wherein the motion pattern optimizes an operational efficiency of the thermodynamic engine.

18. The apparatus recited in claim 14 wherein the thermodynamic air engine further comprises a coil and a permanent magnet mechanically coupled with the displaccr.

19. The apparatus recited in claim 14 wherein the thermodynamic air engine further comprises an electronic solenoid interfaced with the displacer to provide the direct actuation of the displacer.

20. The apparatus recited in claim 14 wherein the thermodynamic air engine further comprises a rotary motor interfaced with the displacer to provide the direct actuation of the displaccr.

21. The apparatus recited in claim 20 wherein the rotary motor is selected from the group consisting of a rotary dc motor, a rotary ac motor, and a rotary stepper motor.

22. The apparatus recited in claim 14 further comprising:

a source of compressed fluid; and a valve arrangement to deliver the compressed fluid to provide the direct actuation of the displacer.

23. The apparatus recited in claim 14 wherein the displacer comprises a thermally insulating material.

* * * * *

UNITED STATES PATENT AND TRADEMARK OFFICE

CERTIFICATE OF CORRECTION

PATENT NO. : 7,805,934 B1
APPLICATION NO. : 11/734883
DATED : October 5, 2010
INVENTOR(S) : Brian P. Nuel et al.

It is certified that error appears in the above-identified patent and that said Letters Patent is hereby corrected as shown below:

Column 10, Line 43, delete "displaccr" and insert -- displacer --

Column 10, Line 51, delete "displaccr" and insert -- displacer --

Signed and Sealed this

Seventh Day of December, 2010

David J. Kappos

David J. Kappos
*Director of the United States Patent and Trademark Office*